US006338169B1

(12) United States Patent
DeGarie

(10) Patent No.: US 6,338,169 B1
(45) Date of Patent: Jan. 15, 2002

(54) FLOATING COVER FOR LARGE LIQUID RESERVOIR

(76) Inventor: Claude J. DeGarie, 1133 Regent Street, Suite 300, Fredericton, New Brunswick (CA), E3B 3Z2

( * ) Notice: Subject to any disclaimer, the term of this patent is extended or adjusted under 35 U.S.C. 154(b) by 0 days.

(21) Appl. No.: 09/690,716

(22) Filed: Oct. 18, 2000

(51) Int. Cl.[7] ..... B65D 88/34; E04H 4/06
(52) U.S. Cl. ..... 4/498; 220/216
(58) Field of Search ..... 4/498, 499, 503; 220/216, 218, 219

(56) References Cited

U.S. PATENT DOCUMENTS

| | | | | |
|---|---|---|---|---|
| 3,313,443 A | | 4/1967 | Dial et al. | 220/26 |
| 3,683,428 A | | 8/1972 | Morris | 4/172.14 |
| 3,980,199 A | | 9/1976 | Kays | 220/227 |
| 3,991,900 A | * | 11/1976 | Burke et al. | |
| 4,000,527 A | * | 1/1977 | Gannon | 4/499 |
| 4,139,117 A | | 2/1979 | Dial | 220/218 |
| 4,181,986 A | | 1/1980 | Aine | 4/172.14 |
| 4,192,025 A | | 3/1980 | Hinsperger | 4/172.14 |
| 4,438,863 A | | 3/1984 | Wilson et al. | 220/227 |
| 4,446,983 A | * | 5/1984 | Gerber | |
| 4,503,988 A | | 3/1985 | Gerber | 220/219 |
| 4,603,790 A | | 8/1986 | Gerber | 220/219 |
| 4,672,691 A | | 6/1987 | De Garie et al. | 4/499 |
| 5,505,848 A | | 4/1996 | Landine | 210/170 |
| 5,587,080 A | | 12/1996 | Landine et al. | 210/603 |
| 6,119,284 A | * | 9/2000 | Cosman | 4/498 |

* cited by examiner

*Primary Examiner*—Charles R. Eloshway
(74) *Attorney, Agent, or Firm*—Mario Theriault

(57) ABSTRACT

The floating cover has a floating grid anchored to the perimeter walls of the reservoir, and floats over the liquid level inside the reservoir. The floating grid comprises a flexible keel member and an array of flexible buoyant beams affixed to the keel member. A flexible impermeable membrane is affixed to the perimeter wall and is loosely laid over the floating grid. An array of flexible weight lines is anchored to the perimeter walls and is loosely laid over the impermeable membrane. Each weight line is laid at about halfway between an adjacent pair of buoyant beams. The floating grid, the impermeable membrane and the array of weight lines constitute three separate layers that are movable relative to each other without generating destructive stress in the impermeable membrane.

20 Claims, 5 Drawing Sheets

FLOATING COVER FOR LARGE LIQUID RESERVOIR

FIELD OF THE INVENTION

This invention pertains to flexible floating covers for covering large liquid reservoirs, and particularly it relates to a floating cover which is anchored to the perimeter walls of a reservoir and which rises and falls with the liquid level inside the reservoir.

BACKGROUND OF THE INVENTION

Floating covers are mounted over settling ponds and clarifiers to contain and collect fermentation gases of mill effluent for example. Floating covers are also mounted over water reservoirs to prevent contamination of potable water from acid rain, pollen, leaves, dust, insects, bird droppings, the effect of sunlight and from the activities of other animals.

The installation of a floating cover over a large liquid reservoir represents certain difficulties in that the cover is exposed to the elements and to the movement of the liquid under the cover. For example, a slight accumulation of rain over a cover creates puddles and mounds which catch the wind and promote waves along the cover and into the liquid under the cover. The movement of liquid under the cover causes tangential stresses and constant movement in the cover. These stresses could cause fatigue, localized elongation and rupture of the cover. The formation of mounds and puddles on a floating cover is amplified where the cover is installed over a reservoir that could have gases coming out of the liquid inside the reservoir.

Examples of floating covers of the prior art are described in the following documents:

U.S. Pat. No. 3,313,443, issued on Apr. 11, 1967 to H. S. Dial et al.;

U.S. Pat. No. 3,683,428, issued on Aug. 15, 1972 to L. Morris;

U.S. Pat. No. 3,980,199, issued on Sep. 14, 1976 to W. B. Kays;

U.S. Pat. No. 4,139,117, issued on Feb. 13, 1979 to H. S. Dial;

U.S. Pat. No. 4,181,986, issued on Jan. 8, 1980 to H. E. Aine;

U.S. Pat. No. 4,192,025, issued on Mar. 11, 1980 to C. A. Hinsperger;

U.S. Pat. No. 4,438,863, issued on Mar. 27, 1984 to J. V. Wilson et al.;

U.S. Pat. No. 4,503,988, issued on Mar. 12, 1985 to D. H. Gerber;

U.S. Pat. No. 4,603,790, issued on Aug. 5, 1986 to D. H. Gerber;

U.S. Pat. No. 4,672,691, issued on Jun. 16, 1987 to De Garie et al.;

U.S. Pat. No. 5,505,848, issued on Apr. 9, 1996 to Landine et al.;

U.S. Pat. No. 5,587,080, issued on Dec. 24, 1996 to Landine et al.

A common method in the prior art for supporting a floating cover over a reservoir consists of bonding float blocks to the underside of the impermeable membrane, or positioning float blocks inside pockets formed in the membrane. This method has had limited success in the past because the float blocks and pockets cause obstructions which catch the liquid movement under the cover and apply tearing stresses along the surface of the cover. Where the cover is installed over a clarifier or a pond and scum tends to form at the surface of the pond, the wind-induced movement in the liquid of the pond and associated scum movement under the cover generate forces that can rip a float block or a pocket away, and tear the strongest impermeable membrane.

Therefore, it is believed that there is a need in the industry for a better flexible floating cover which is adapted to minimize the formation of puddles and mounts thereon and which is less susceptible of generating destructive stresses from wind-induced liquid movement under the cover.

SUMMARY OF THE INVENTION

In the present invention, there is provided a floating cover for liquid reservoir wherein the structure of the cover is particularly flexible to follow the movement of the liquid inside the reservoir without generating excessive tangential stress in the water-impermeable membrane of the cover. Specific segments of the cover become quickly submersed during a rainstorm to keep the cover membrane taut and to limit the formation of randomly spaced puddles that can deform the cover and create stresses in the cover membrane.

In a first aspect of the present invention there is provided a liquid reservoir having a floating cover mounted thereon. The floating cover has a floating grid anchored to the perimeter walls of the reservoir. The floating grid floats over the liquid inside the reservoir. The floating grid comprises a keel member and an array of buoyant beams affixed to the keel member and extending away from the keel member. A water-impermeable membrane is affixed to the perimeter wall and is loosely laid over the floating grid. There is also provided an array of weight lines anchored to the perimeter walls and loosely laid over the impermeable membrane. Each of the weight lines is laid at about halfway between an adjacent pair of the buoyant beams.

The primary advantage of this structure is that the floating grid, the impermeable membrane and the array of weight lines constitute three separate layers that are loosely laid over each other. These three separate layers are therefore free to slide upon each other and flex to follow the movement of the liquid inside the reservoir without generating any destructive tangential stress in the impermeable membrane.

In another feature of the present invention, the buoyant beams and the weight lines are flexible longitudinally whereby a relative movement of the impermeable membrane between the floating grid and the array of weight lines does not generate any point of concentrated shear stresses in the impermeable membrane.

In still another feature of the present invention, the impermeable membrane has segments that are quickly submersed under the liquid level during a rainstorm. The submersed segments extend along the keel member and along the weight lines. These submersed segments are advantageous for keeping the impermeable membrane in a taut condition during a rainstorm, and for reducing the formation of puddles and mounds thereon.

In accordance with yet another feature of the present invention, the impermeable membrane has a series of drain holes therein. The drain holes are located in a central one third portion of the width of the impermeable membrane. Due to the location of these drain holes, the submersed segments remain present on the impermeable membrane for extended period of time following a rainstorm. Furthermore, the drain holes in the cover of the present invention represent a distinct advantage over the traditional use of hazardous electrical sump pumps.

Other advantages and novel features of the present invention will become apparent from the following detailed description.

BRIEF DESCRIPTION OF THE DRAWINGS

An embodiment of the present invention is illustrated in the accompanying drawings, in which like numerals denote like parts throughout the several views, and in which.

DETAILED DESCRIPTION OF THE PREFERRED EMBODIMENT

Figure 1:
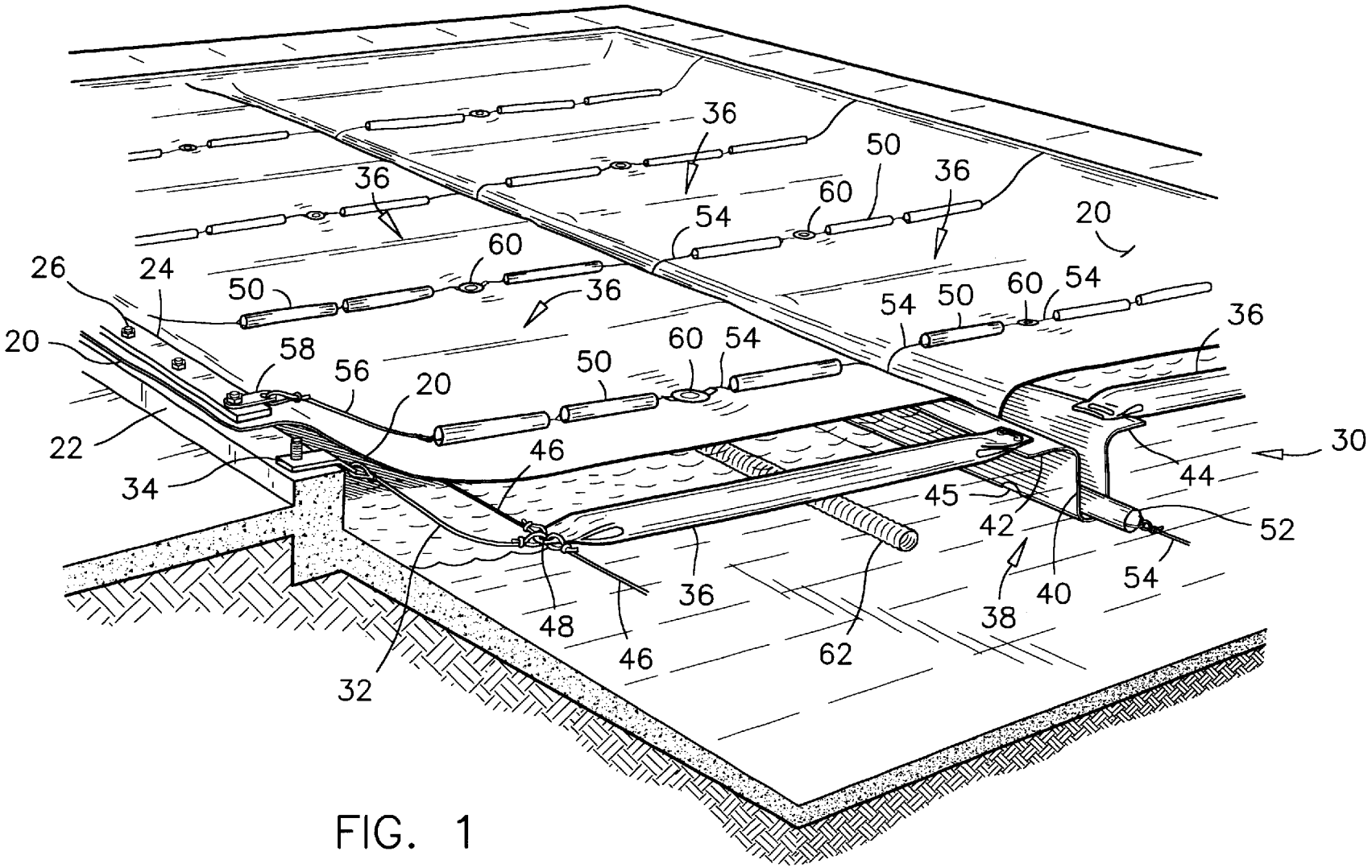
FIG. 1 is a partial perspective view of a floating cover according to a preferred embodiment of the present invention installed over a liquid reservoir.

While this invention is susceptible of embodiments in many different forms, there is shown in the drawings and will be described in details herein one specific embodiment of the present invention, with the understanding that the present disclosure is to be considered as an example of the principles of the invention and is not intended to limit the invention to the embodiment illustrated and described.

Figure 2:
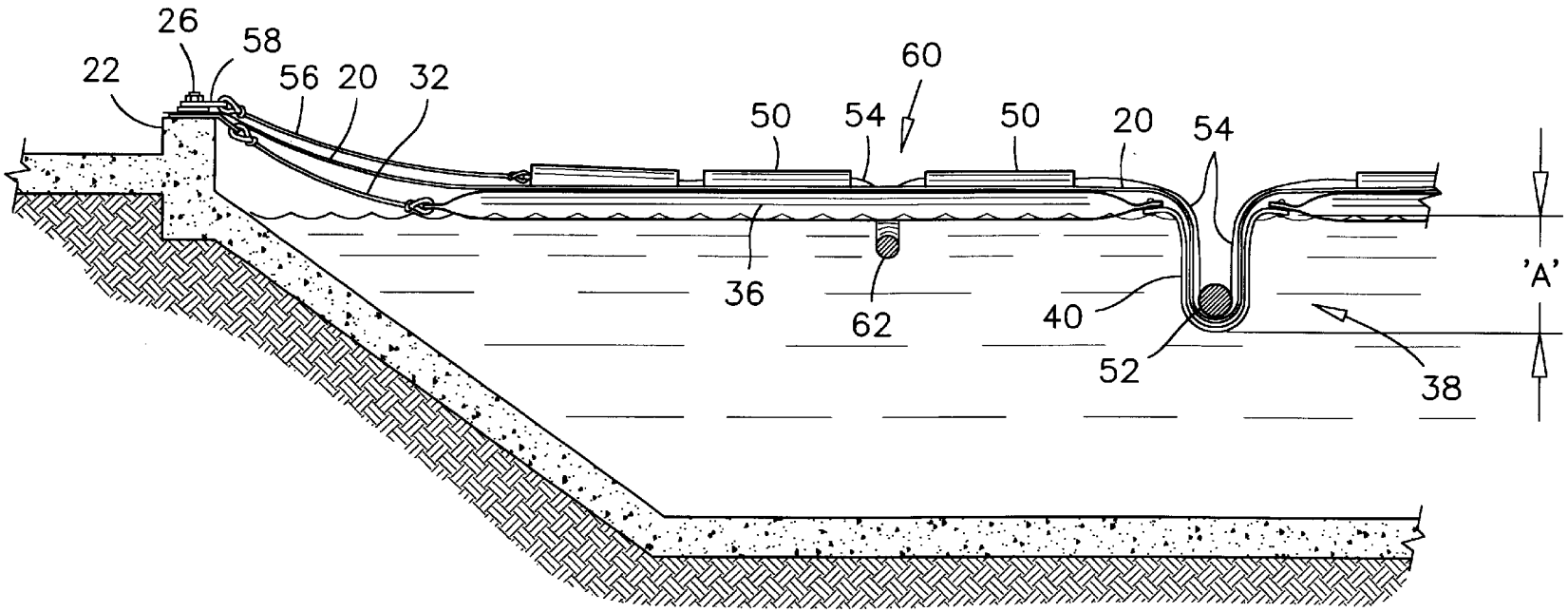
FIG. 2 is a partial cross-section view of the floating cover.
Figure 3:
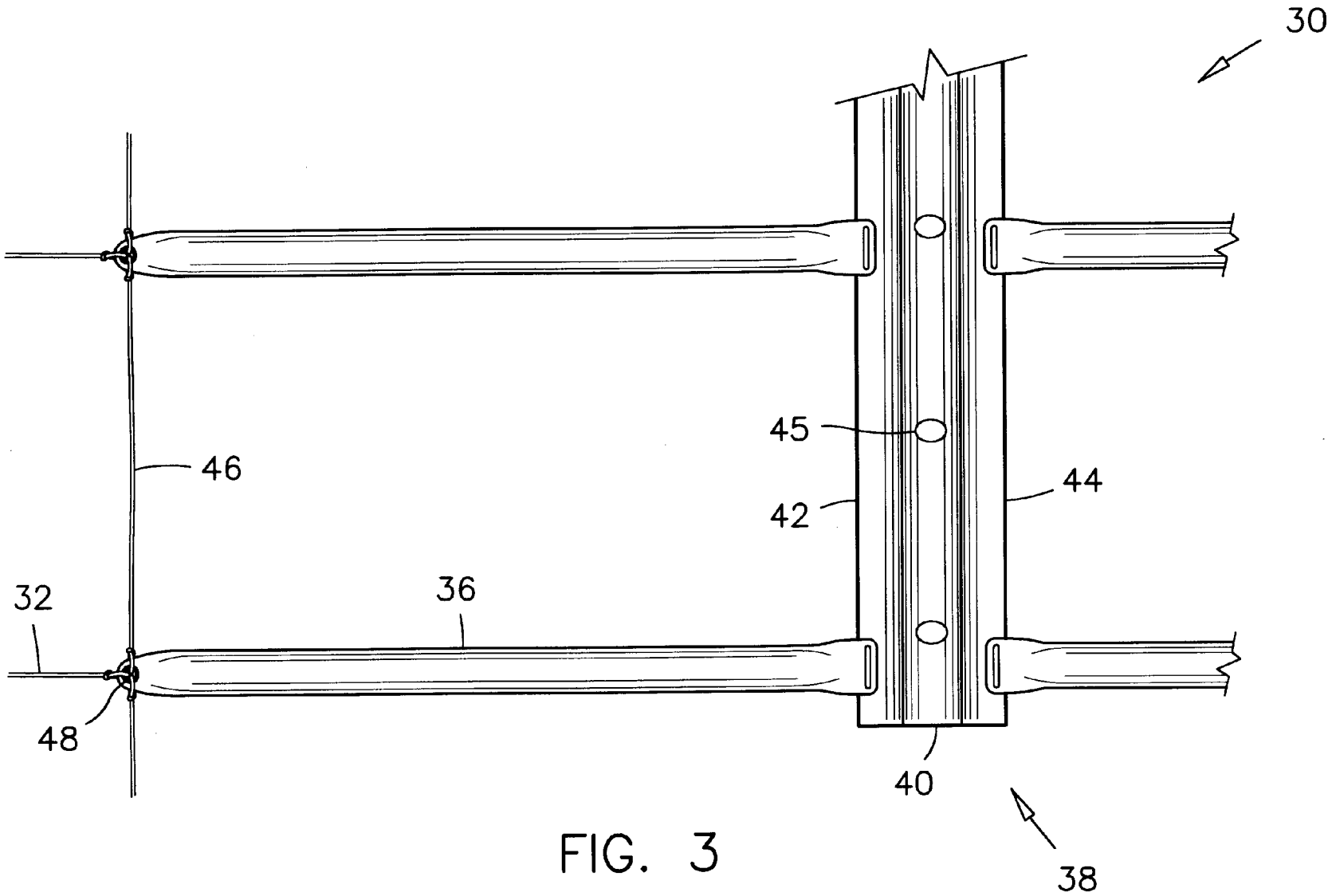
FIG. 3 is a partial top view of the floating grid supporting the impermeable membrane.

A preferred embodiment of the flexible floating cover according to the present invention is partly illustrated in FIGS. 1 and 2. The floating grid supporting the impermeable membrane of the floating cover is partly illustrated in FIG. 3. These partial drawings are provided herein for clarity. These drawings are believed to be sufficient for illustrating the concept and principles of the present invention. Numerous other structural details or variations may be included in a complete cover installation. However, these additional structural details and variations are known to those skilled in the art. The floating cover according to the present invention is an improvement to the floating cover described in U.S. Pat. No. 4,672,691 of which the first named inventor is also the inventor of the present invention.

The floating cover according to the preferred embodiment comprises a flexible water-impermeable membrane 20 which is anchored to the perimeter wall 22 of a reservoir. A flat bar 24 and a series of anchor bolts 26 are used for clamping the impermeable membrane 20 to the top edge of the wall 22. The impermeable membrane 20 has sufficient surface to cover the reservoir at its lowest operating level. The flexible impermeable membrane 20 is preferably made of a stretch-resistant nylon-based pliable sheet material.

The impermeable membrane 20 is loosely supported at the surface of the reservoir by a floating grid 30. The floating grid is also anchored to the perimeter wall 22 by means of tie cables 32 and connector plates 34 mounted to the anchor bolts 26. The floating grid 30 is made of a series of buoyant beams 36 attached to and extending from a keel member 38 set along the centre of the floating grid 30. Each buoyant beam 36 has an inside end attached to the keel member 38. The outside end of each buoyant beam 36 is retained to the perimeter wall by a tie cable 32.

Each buoyant beam 36 has a bag-like shape and is filled with chunks of foam or similar buoyant material. The envelope of each buoyant beam 36 is preferably made of a different material than the material of the impermeable membrane 20. The envelope of each buoyant beam 36 is preferably made of a stretch-resistant polyethylene pliable sheet material. The difference in material between the impermeable membrane 20 and each buoyant beam 36 ensures that the two materials do not fuse together in use, when exposed to excessive heat from the sun's rays.

Because of the polyethylene sheet material, each buoyant beam 36 is somewhat flexible lengthwise and widthwise to follow to a certain degree the wave movements of the liquid under the cover. Moreover, it has been found that the coefficient of friction between the buoyant beams 36 and the impermeable membrane 20 in the presence of a water is very low, whereby a relative movement of the impermeable membrane 20 over one of the buoyant beams 36 does not apply any significant tangential stress in the impermeable membrane 20. It is believed that the flexibility of the buoyant beams 36 is also a contributing factor for providing a low stress contact between the impermeable membrane 20 and the buoyant beams 36.

The central keel member 38 is made of several plies of the same material as the buoyant beams 36, that is a stretch-resistant polyethylene pliable sheet material. The keel member 38 is thereby relatively flexible and has a surface which offers a low coefficient of friction against the surface of the impermeable membrane 20. The keel member 38 comprises a trough 40 and opposite horizontal flaps 42, 44 extending from the trough. The buoyant beams 36 are attached to the flaps 42, 44 and extend substantially at right angle with the keel member 38. A series of perforations 45 through the bottom segment of the trough 40, evacuate the liquid that may be trapped inside the trough between the bottom segment of the trough and the central portion of the impermeable membrane 20.

The height 'A' of the trough 40 constitutes spare surface for accommodating the widthwise extension and contraction of the floating grid 30 and of the impermeable membrane 20, as the liquid level changes inside the reservoir. When the liquid level rises in the reservoir to its upper level as shown in FIG. 2, the central portion of the impermeable membrane 20 accumulates in the central trough 40.

Optional transverse cables 46 may also be used between the outside ends of the buoyant beams 36 to retain the buoyant beams in a parallel orientation with each other. The use of transverse cables 46 is advantageous for stabilizing a floating grid 30 over a larger reservoir. A grommet 48 on the outside end of each buoyant beam 36 is used to retain cables 32 and 46.

The floating cover according to the preferred embodiment also comprises an array of lateral weight lines 50 laid over the impermeable membrane 20, each being laid at about halfway between an adjacent pair the buoyant beams 36. The lateral weight lines 50 are linked to a central weight line 52 which is laid inside the trough 40 of the keel member 38. The lateral weight lines 50 and the central weight line 52 are made of a plurality of pipe sections filed with sand or concrete for example. The pipe sections in the lateral weight lines 50 and the central weight line 52 are linked to each other by rope 54 or light cable, such that each weight line is longitudinally flexible to follow the movement of the membrane with any wave action in the covered liquid. The outside end of each lateral weight line 50 is anchored to the perimeter wall 22 of the reservoir by means of an anchor cable 56 attached to an anchor tab 58 mounted to one an anchor bolt 26 above the membrane clamping flat bar 24.

Because the weight lines 50, 52 and the buoyant beams 36 are relatively flexible longitudinally, their movement relative to the impermeable membrane 20 do not apply significant concentrated shear stress in the impermeable membrane.

The function of the central weight line 54 is to cause the flexible trough 40 to sink below the level of liquid inside the reservoir and to entrain the central portion of the impermeable membrane 20 inside the trough 40.

Figure 4:
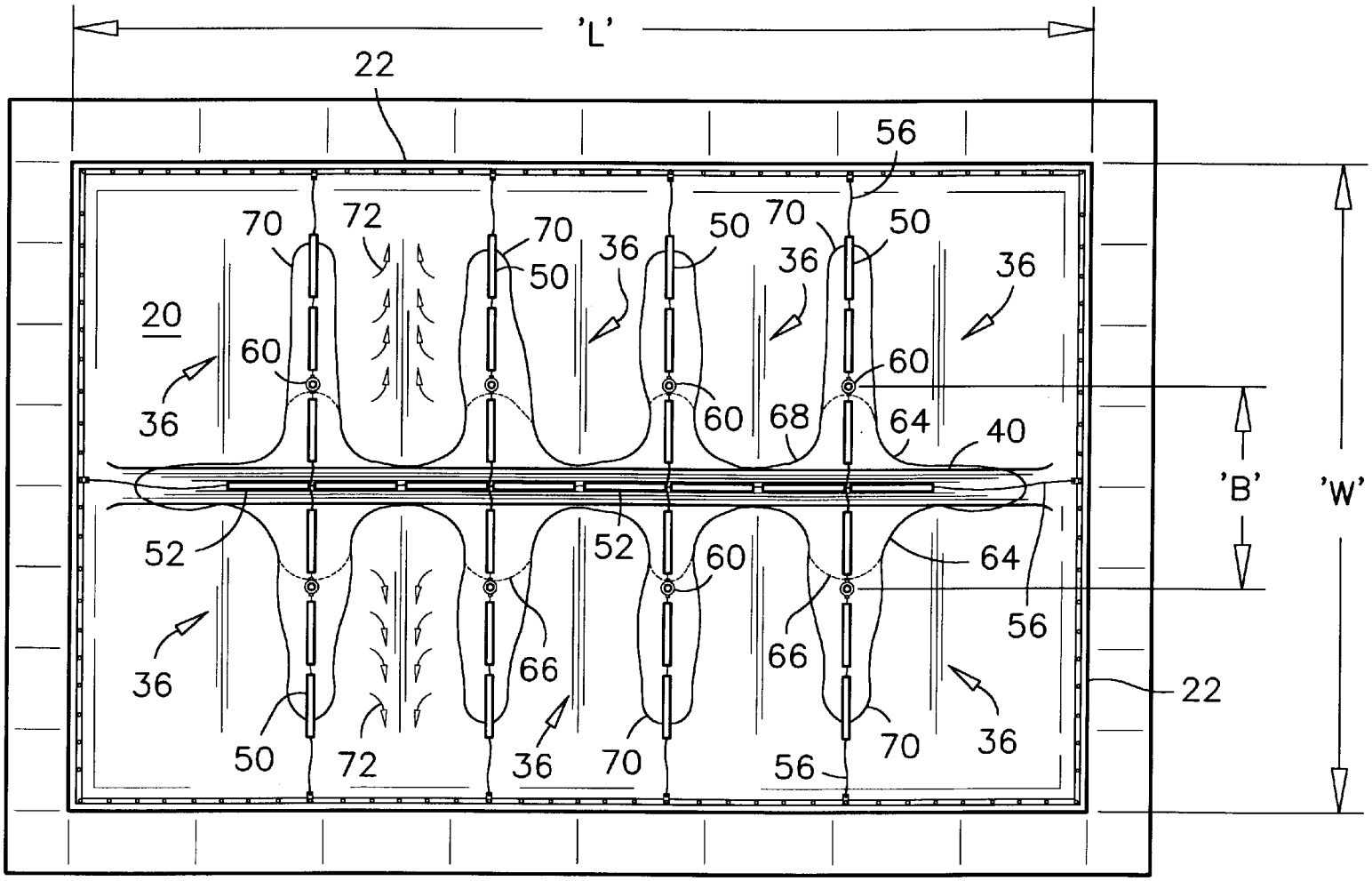
FIG. 4 is a top view of a rectangular reservoir having the floating cover according to the preferred embodiment mounted thereon.

A first function of the lateral weight lines 50 is to cause lateral depressions on the membrane surface around several drain holes 60 through the impermeable membrane 20. These drain holes 60 are located between the buoyant beams 36, and in the central portion 'B' of the cover, as shown in FIG. 4. This central portion 'B' represents about one third of the width 'W' of the cover. The ropes 54 of the weight line above a drain hole 60 are preferably attached to the drain hole to retain the weight line to that drain hole. When rainwater is considered a contaminant relative to the content of the reservoir, the drain holes 60 are connected to each other and to one or more drain pipes 62 which are routed outside the reservoir.

Referring again to FIG. 4, it will be better understood that the flexible trough 40 accumulates a spare surface of the impermeable membrane 20 for accommodating extension and contraction of the impermeable membrane 20 across the width 'W' of the reservoir, when the liquid level changes inside the reservoir. Similarly, a second function of the lateral weight lines 50 is to cooperate with the buoyant beams 36 and form peaks and valleys across the length 'L' of the reservoir to accumulate a spare surface of the impermeable membrane 20 along the length 'L' of the reservoir, to accommodate for the lengthwise extension and contraction of the impermeable membrane 20 as the liquid level change inside the reservoir. The lengths of the anchor cables 56, of the tie cables 32 and of the intermediate ropes 54, and the height 'A' of the trough 40 are selected to allow unrestricted vertical movement of the impermeable membrane 20 over the expected level variations of the liquid inside the reservoir.

FIG. 4 also illustrates a typical accumulation of rainwater over the cover. As mentioned before, the buoyant beams 36 cause transverse ridges in the impermeable membrane 20, and the lateral weight lines 50 causes depressions in the membrane between the ridges. Rainwater accumulates inside the trough 40 and in the depressions much like according to the illustrated contour line 64. As rainwater is evacuated through the drain holes 60 the size of the puddles recedes toward the central trough 40 until the water line is within the central region of the cover such as illustrated by label 66. The rainwater remaining inside and along the central trough 40 is slowly evacuated by evaporation.

The advantages of this installation is that rainwater has a stabilizing effect on the cover during a rainstorm by submersing the central segment 68 of the membrane and a series of rib-like lateral segments 70. Because of these submersed segments 68, 70, the impermeable membrane 20 is kept taut and the surface of the membrane exposed to uplifting wind forces is greatly reduced. Because of the position of the drain holes 60 in the central one third portion of the impermeable membrane 20, the submersed segments 68, 70 are still present when the rainwater recedes to a low level 66 beyond the drain holes 60. The stabilizing effect is therefore maintained during and after a rainstorm.

Additionally, the floating grid 30, the impermeable membrane 20 and the array of weight lines 50, 52 are free to move relative to each other. Therefore, any liquid movement under the membrane 20 is less susceptible of applying excessive tangential stress in the membrane.

The ridges created by the buoyant beams 36 still offer gas passages under the membrane 20 whereby any off-gas generated by the content of the reservoir can be evacuated along the buoyant beams 36 and toward the perimeter wall 22 of the reservoir, such as illustrated by arrows 72.

Figure 5:
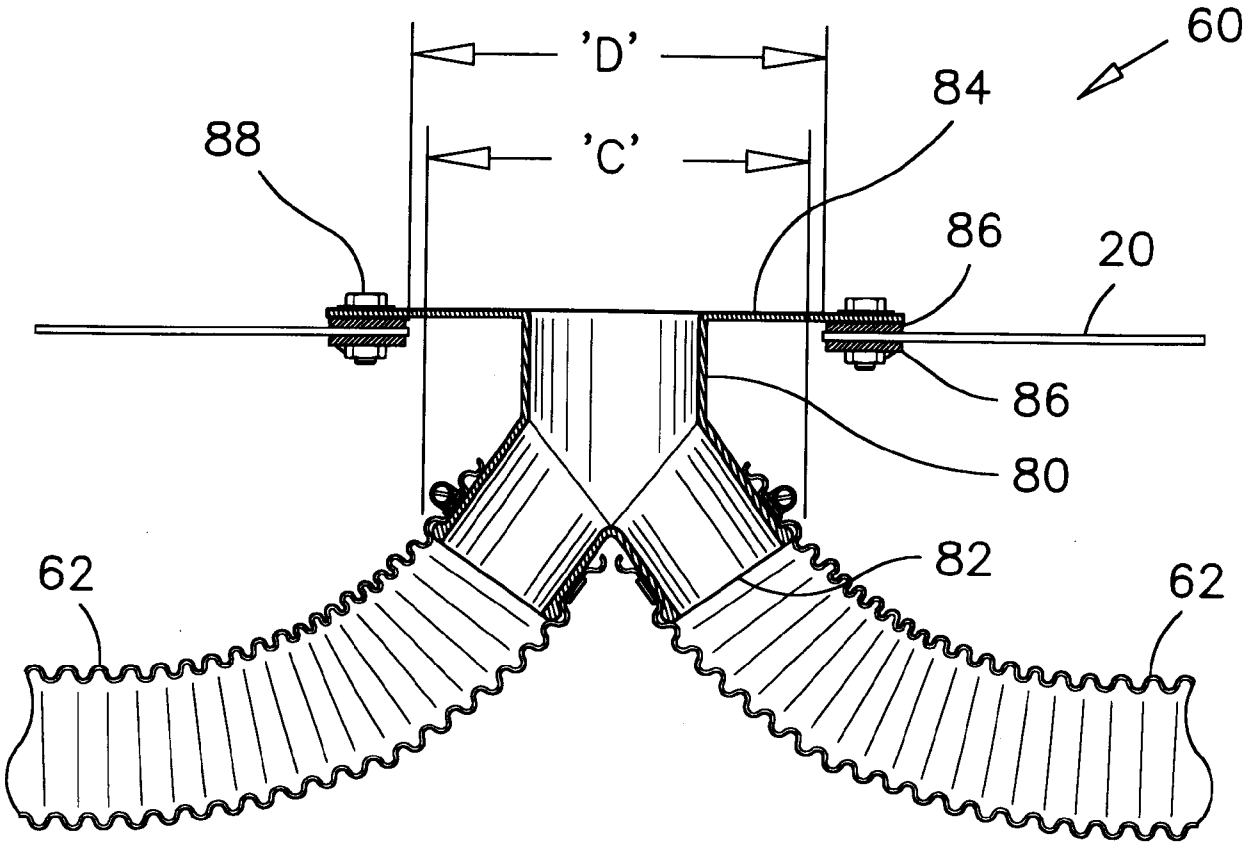
FIG. 5 illustrates a cross-section of one of the drain holes through the impermeable membrane of the floating cover.

Referring now to FIG. 5, there is illustrated therein the structural arrangement of a preferred drain hole 60. Each drain hole 60 has an inverted Y-shaped fitting 80, the legs 82 of which retain segments of the drain hose 62. The fitting 80 has a flange 84 which is bolted to a pair of washers 86, one on each side of the impermeable membrane 20. The washers 86 have an inside diameter 'D' which is larger than the maximum width 'C' of the fitting 80, across the legs 82. The fitting 80 is removable from the washers 86 by removing a series of bolts 88. The fitting 80 and the drain hose segments 62 are retrievable from under the impermeable membrane 20 through the opening 'D', for inspection, repair or replacement of the drainage system, without removing the cover.

While one embodiment of the present invention has been illustrated in the accompanying drawings and described hereinabove, it will be appreciated by those skilled in the art that various modifications, alternate constructions and equivalents may be employed without departing from the true spirit and scope of the invention. Therefore, the above description and the illustrations should not be construed as limiting the scope of the invention which is defined by the appended claims.

I claim:

1. In combination, a liquid reservoir and a floating cover mounted over said liquid reservoir, said liquid reservoir having a liquid level, a length, a width and perimeter walls defined by said length and width, and said floating cover comprising:

a floating grid anchored to said perimeter walls and floating over said liquid level, said floating grid comprising a keel member and an array of buoyant beams affixed to said keel member;

an impermeable membrane affixed to said perimeter walls and loosely laid over said floating grid; and an array of weight lines anchored to said perimeter walls and loosely laid over said impermeable membrane, with each of said weight lines being laid at about halfway between an adjacent pair of said buoyant beams;

such that said floating grid, said impermeable membrane and said weight lines are free to move relative to each other as a result of liquid movement inside said reservoir without causing destructive tangential stress in said impermeable membrane.

2. The combination as claimed in claim 1, wherein said flexible keel extends along said length and said buoyant beams extend along said width.

3. The combination as claimed in claim 1, wherein said flexible keel member comprises a trough and opposite flaps extending from said trough.

4. The combination as claimed in claim 3, wherein said buoyant beams are affixed to said flaps and extend substantially at right angles with said trough.

5. The combination as claimed in claim 1, wherein said impermeable membrane is made of a stretch resistant nylon-based pliable sheet material.

6. The combination as claimed in claim 5, wherein said buoyant beams comprises an envelope filled with chunks of foam.

7. The combination as claimed in claim 6, wherein said envelope is made of a stretch-resistant polyethylene pliable sheet material.

8. The combination as claimed in claim 5, wherein said keel member is made of a stretch-resistant nylon-based pliable sheet material.

9. The combination as claimed in claim 8, wherein said keel member comprises several plies of said stretch resistant nylon-based pliable sheet material.

10. The combination as claimed in claim 1, wherein said impermeable membrane comprises drain holes under said weight lines.

11. The combination as claimed in claim 10, wherein said drain holes are located in a central one third portion of said width and said array of weight lines.

12. The combination as claimed in claim 11, wherein each of said weight lines comprising a plurality of pipe sections filled with sand.

13. The combination as claimed in claim 12, wherein said pipe sections are attached to each other and to said drain holes with ropes.

14. In combination, a liquid reservoir and a floating cover mounted over said liquid reservoir, said liquid reservoir having a liquid level, a length, a width and perimeter walls defined by said length and width; said floating cover comprising:

a floating grid anchored to said perimeter walls and floating over said liquid level, said floating grid comprising a keel member extending along said length and an array of spaced-apart buoyant beams affixed to said keel member and extending along said width;

an impermeable membrane affixed to said perimeter walls and laid over said floating grid; and an array of weight lines anchored to said perimeter walls and laid over said impermeable membrane; said array of weight lines comprising lateral weight lines, each of which being laid over said impermeable membrane at about halfway between an adjacent pair of said buoyant beams;

said impermeable membrane having segments submersed under said liquid level along said keel member and along said weight lines;

such that said impermeable membrane is relatively stable in windy conditions.

15. The combination as claimed in claim 14, wherein said impermeable membrane comprises drain holes therein disposed along said weight lines.

16. The combination as claimed in claim 15, wherein said drain holes are disposed in a central one third portion of said impermeable membrane relative to said width.

17. The combination as claimed in claim 14, wherein said array of weight lines comprises a central weight line laid over said keel member.

18. In combination, a liquid reservoir and a floating cover mounted over said liquid reservoir, said liquid reservoir having a liquid level, a length, a width and perimeter walls defined by said length and width; said floating cover comprising:

a floating grid anchored to said perimeter walls and floating over said liquid level, said floating grid comprising a keel member extending along said length and an array of spaced-apart buoyant beams affixed to said keel member and extending along said width;

an impermeable membrane affixed to said perimeter walls and loosely laid over said floating grid; and an array of weight lines anchored to said perimeter walls and loosely laid over said impermeable membrane; said array of weight lines comprising lateral weight lines, each of which being laid over said impermeable membrane at about halfway between an adjacent pair of said buoyant beams; said impermeable membrane having segments submersed under said liquid level along said keel member and under said lateral weight lines;

such that said impermeable membrane is relatively stable in windy conditions, and said floating grid, said impermeable membrane and said weight lines are free to move relative to each other as a result of liquid movement inside said reservoir without causing destructive tangential stress in said impermeable membrane.

19. The combination as claimed in claim 18, wherein said weight lines and said buoyant beams are longitudinally flexible.

20. The combination as claimed in claim 18, wherein said submersed segments are rib-like segments spaced apart along said length of said reservoir and joining a central segment along said keel member.

* * * * *